US007798768B2

(12) United States Patent
Strain et al.

(10) Patent No.: US 7,798,768 B2
(45) Date of Patent: Sep. 21, 2010

(54) TURBINE VANE ID SUPPORT

(75) Inventors: John Strain, Tequesta, FL (US); Yevgeniy Shteyman, West Palm Beach, FL (US); Robert W. Spitzer, Casselberry, FL (US)

(73) Assignee: Siemens Energy, Inc., Orlando, FL (US)

( * ) Notice: Subject to any disclaimer, the term of this patent is extended or adjusted under 35 U.S.C. 154(b) by 1001 days.

(21) Appl. No.: 11/586,454

(22) Filed: Oct. 25, 2006

(65) Prior Publication Data

US 2008/0101927 A1 May 1, 2008

(51) Int. Cl.
*F01D 9/04* (2006.01)
*F01D 11/00* (2006.01)

(52) U.S. Cl. ..... 415/135; 415/138; 415/139; 415/189; 415/190; 415/209.3; 60/752; 60/796; 60/800

(58) Field of Classification Search ..... 415/135, 415/136, 138, 139, 189, 190, 209.2, 209.3, 415/209.4, 210.1, 134; 60/752, 796, 800
See application file for complete search history.

(56) References Cited

U.S. PATENT DOCUMENTS

| | | | | |
|---|---|---|---|---|
| 2,625,013 | A | | 1/1953 | Howard et al. |
| 4,083,648 | A | | 4/1978 | Asplund |
| 4,883,405 | A | | 11/1989 | Walker |
| 4,907,946 | A | | 3/1990 | Ciokajlo et al. |
| 5,271,714 | A | | 12/1993 | Shepherd et al. |
| 5,343,694 | A | * | 9/1994 | Toborg et al. ..... 60/796 |
| 5,591,003 | A | | 1/1997 | Boyd et al. |
| 5,868,398 | A | * | 2/1999 | Maier et al. ..... 277/643 |
| 6,179,560 | B1 | | 1/2001 | Kouris et al. |
| 6,517,313 | B2 | | 2/2003 | Rogers |
| 6,530,744 | B2 | | 3/2003 | Liotta et al. |
| 6,637,752 | B2 | | 10/2003 | Aksit et al. |
| 6,637,753 | B2 | | 10/2003 | Mohammed-Fakir et al. |
| 6,652,229 | B2 | | 11/2003 | Lu |
| 2003/0129055 | A1 | | 7/2003 | Leeke et al. |
| 2003/0161726 | A1 | | 8/2003 | Lu |
| 2004/0013519 | A1 | | 1/2004 | Correia et al. |

* cited by examiner

*Primary Examiner*—Christopher Verdier

(57) ABSTRACT

A turbine vane ID support system usable to support the ID of a turbine vane and including a transition seal system and a turbine vane ID forward rail seal system. The transition seal system may seal the turbine vane ID support body to a transition, and the turbine vane ID forward rail seal system may seal the turbine vane ID support body to a turbine vane. Use of the transition seal system and the turbine vane ID forward rail seal system eliminates the problems inherent with conventional seals used to seal transitions directly to turbine vanes. The turbine vane ID support system may also be configured such that the turbine vane ID support system may be removed to facilitate removal of turbine vanes and blades for repair or replacement.

20 Claims, 2 Drawing Sheets

TURBINE VANE ID SUPPORT

FIELD OF THE INVENTION

This invention is directed generally to turbine airfoils, and more particularly to support systems for hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures. Turbine engines typically include a plurality of rows of stationary turbine vanes extending radially inward from a shell and include plurality of rows of rotatable turbine blades attached to a rotor assembly for turning the rotor.

Row one turbine vanes may be axially supported at the ID end of the vanes. Such support schemes for row one turbine vanes should provide fail-safe support structures operable under extreme structural and thermal loading. Conventional support schemes include supporting the row one turbine vane at an OD shroud aft rail and at an ID shroud aft rail from the shaft cover positioned radially inward of the turbine vane. However, such an arrangement can lead to significant leakage at the aft rail because the tangential aero load on the vane can unseat the sealing surfaces at the airfoil concave side end of the aft rails, as shown in FIG. 1. Sealing the turbine vane to the forward end of the shrouds is also complicated because rotation of the turbine vane due to the tangential aero load creates differences in the axial location of the shroud forward end from one circumferential side of the shroud to the other, which is referred to herein as "sawtoothing." The shaft cover ID support of the vane in many conventional support systems also serves as a seal between the combustor shell and the turbine blade rim cavity. The sealing function of this support is less effective then desired because of the aforementioned tendency of the aft sealing surfaces to separate. Thus, a need exists for a turbine vane support capable of supporting a turbine vane without allowing twisting about a radial axis to maximize the effectiveness of the seals.

SUMMARY OF THE INVENTION

This invention relates to a turbine vane ID support system usable to support an ID of a row one turbine vane. The turbine vane ID support system may be formed from a turbine vane ID support body with a base configured to be attached to a shaft cover or other support structure. The turbine vane ID support system may include a transition seal system extending from the turbine vane ID support body to seal the turbine vane ID support body to a transition. The turbine vane ID support system may also include a turbine vane ID forward rail seal system extending from the turbine vane ID support body to seal the turbine vane ID support body to an ID forward rail of the turbine vane. Thus, a transition seal seals a transition to the turbine vane ID support body, and a forward rail seal seals the turbine vane ID support body to a forward turbine vane rail, thereby reducing or eliminating the problems inherent with conventional seals used to seal transitions directly to turbine vanes.

The turbine vane ID support system may include a turbine vane ID support body with a base configured to be attached to a shaft cover. The turbine vane ID support body may be formed from a plurality of struts forming one or more cooling fluid flow channels through the turbine vane ID support body. A transition seal system may extend from the turbine vane ID support body to seal the turbine vane ID support body to a transition. A turbine vane ID forward rail seal system may extend from the turbine vane ID support body to seal the turbine vane ID support body to a turbine vane ID forward rail of a turbine vane. The transition seal system may be formed from a transition seal support cavity configured to support a transition seal extending between the turbine vane ID support body and a transition. The transition seal may extend from the turbine vane ID support body. The transition seal may be bent such that a portion of the transition seal that contacts the transition is generally orthogonal to a portion of the transition seal housed in the transition seal support cavity. The turbine vane ID forward rail seal system may include a forward rail seal support cavity configured to support a forward rail seal extending between the turbine vane ID support body and a turbine vane.

The turbine vane ID support system may also include a forward rail support arm extending from the turbine vane ID support body. In one embodiment, the transition seal system and the turbine vane ID forward rail seal system may be coupled to the forward rail support arm. The forward rail support arm may include one or more forward rail receiving slots configured to slideably receive a forward turbine vane rail.

The turbine vane ID support system may also include an aft rail support arm extending from the turbine vane ID support body aft of the forward rail support arm. The turbine vane ID support system may include a turbine vane ID aft rail seal system extending from the aft rail support arm to seal an aft turbine vane rail to the turbine vane ID support body. The turbine vane ID aft rail seal system may be formed from one or more aft rail seal cavities in the aft rail support arm, wherein the aft rail seal cavity may house one or more aft rail seals.

An advantage of this invention is that the turbine vane ID support system reduces turbine vane axial sawtoothing at the shroud leading edge enhancing the effectiveness of the turbine vane ID forward rail sealing system.

Another advantage of this invention is that the turbine vane ID support system improves sealing between a turbine vane and a transition by separating transition seals from the turbine vane seals, which eliminates the need for a single seal to accommodate the radial and axial motion of both the transition and the turbine vane. This results in reduced wear, increased engine performance, and reduced life cycle costs.

Yet another advantage of this invention is that the turbine vane ID support system may be used to reduce the tendency of particles in the combustor shell air to contaminate the row one turbine vane cooling air supply in an air cooled vane design.

Another advantage of this invention is that the turbine vane ID support body is formed in segments that, when combined with multiple segments, forms annular ring. One or more of the segments may be removed to allow inspection and removal of the turbine vanes and adjacent blades without removing the turbine engine cover, thereby resulting in substantial time and cost savings.

Still another advantage of this invention is that if access to the turbine vane is not needed for the full circumference, a portion of the turbine vane ID support body can be integral with the shaft cover to reduce cost and leakage.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 2:
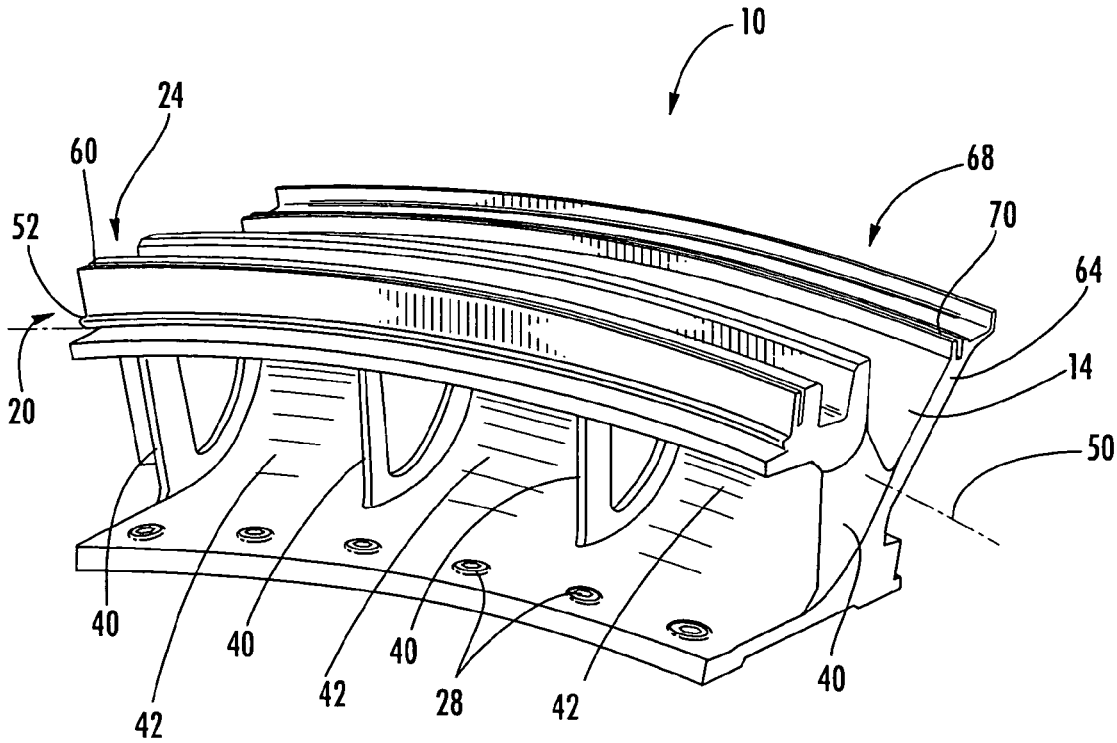
FIG. 2 is a perspective view of a turbine vane ID support body having features according to the instant invention.
Figure 1:
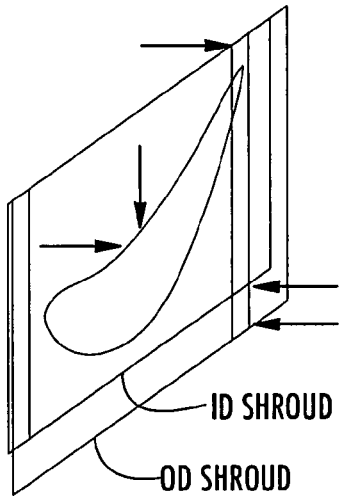
FIG. 1 (PRIOR ART)
FIG. 1 is an end view of a conventional row one turbine vane viewed radially inward and axially supported in a conventional manner from the aft rails of both ID and OD shrouds.

As shown in FIGS. 1-4, this invention is directed to a row one turbine vane ID support system 10 usable to support an ID of a turbine vane 12. The turbine vane ID support system 10 may be formed from a turbine vane ID support body 14 with a base 16 configured to be attached to a shaft cover 18 or other support structure. The turbine vane ID support system 10 may include a transition seal system 20 extending from the turbine vane ID support body 14 to seal the turbine vane ID support body 14 to a transition 22. The turbine vane ID support system 10 may also include a turbine vane ID forward rail seal system 24 extending from the turbine vane ID support body 14 to seal the turbine vane ID support body 14 to a turbine vane ID forward rail 26 of the turbine vane 12. Use of the transition seal system 20 and the turbine vane ID forward rail seal system 24 eliminates the problems inherent with conventional seals used to seal transitions directly to turbine vanes.

Figure 4:
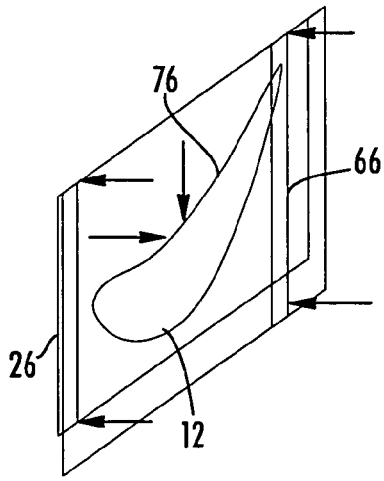
FIG. 4 is an end view of the turbine vane viewed radially inward, axially supported at the aft rail of the OD shroud and forward rail of the ID shroud according to the instant invention.

As shown in FIG. 4, the turbine vane ID support system 10 may be formed from a turbine vane ID support body 14. The turbine vane ID support body 14 may be formed from a base 16 configured to be attached to a stationary support, such as a shaft cover 18 or other appropriate structure. The turbine vane ID support body 14 may be attached with releasable connectors 30, such as bolts, and other appropriate devices inserted through one or more apertures 28. As shown in FIG. 2, the turbine vane ID support body 14 may include apertures 28 in forward and aft regions 32, 34 of the base 16. The turbine vane ID support body 14 may also include apertures 28 in a rear support 36 for attaching the turbine vane ID support body 14 to a support arm 38. As shown in FIG. 2, the turbine vane ID support body 14 may have a generally curved shape such that a plurality of turbine vane ID support bodies 14 may form a circle in a turbine engine.

The turbine vane ID support body 14 may be formed from one or more struts 40 supporting the base 16. The struts 40 may have any appropriate configuration for passing cooling fluids through the turbine vane ID support body 14 and into the turbine vane 12. The struts 40 may form one or more cooling fluid flow channels 42 through the turbine vane ID support body 14.

The turbine vane ID support system 10 may also include a forward rail support arm 44 extending from the turbine vane ID support body 14. The forward rail support arm 44 may include one or more forward rail receiving slots 46 configured to slideably receive a forward turbine vane rail 26. The slots 46 may extend generally along a longitudinal axis 50 of the turbine vane ID support body 14.

Figure 3:
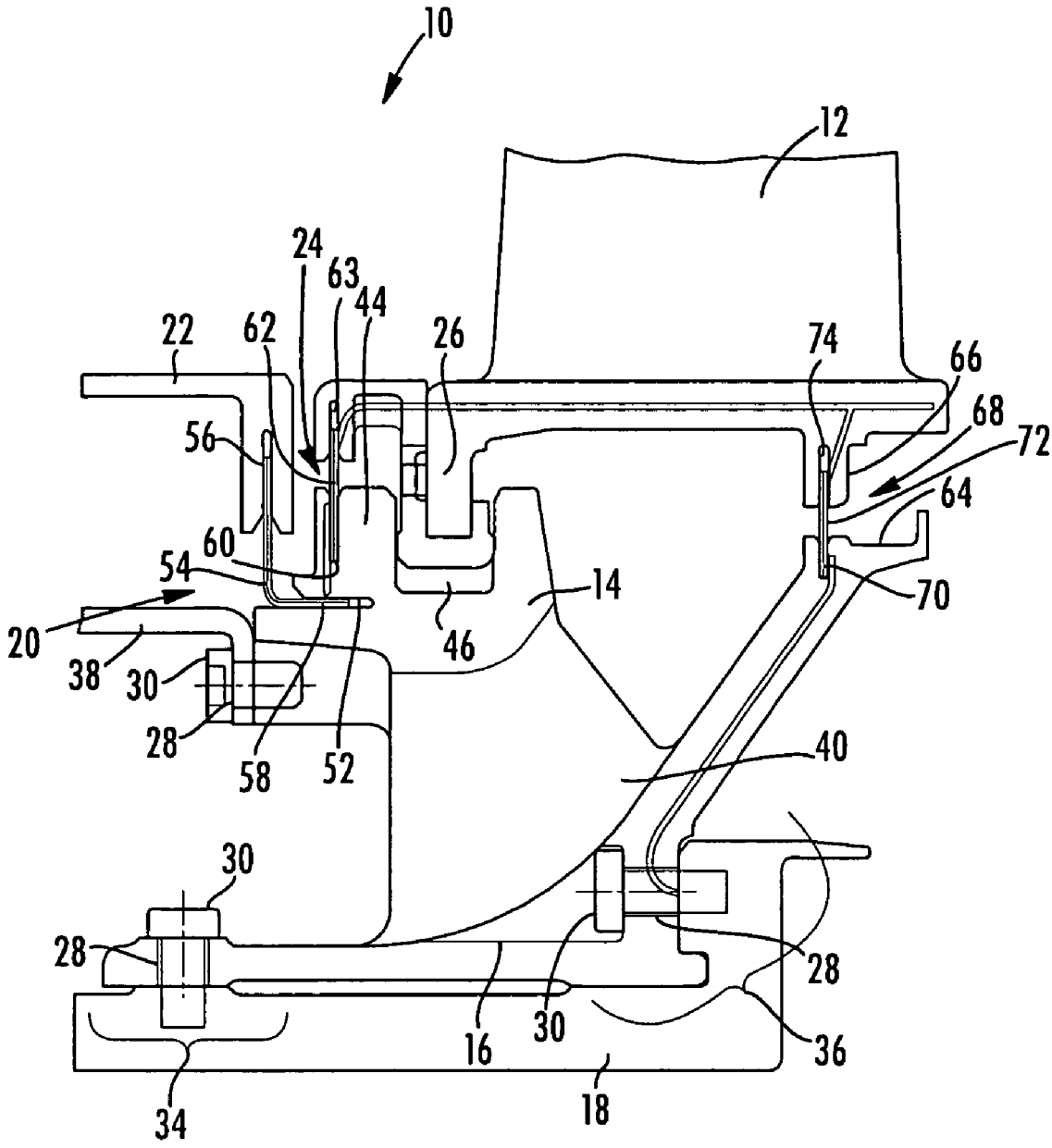
FIG. 3 is a side view of a turbine vane ID support body attached to a shaft cover, a transition, and a row one turbine vane.

As shown in FIG. 3, a transition seal system 20 may extend from the turbine vane ID support body 14 to seal the turbine vane ID support body 14 to a transition 22. In one embodiment, the transition seal system 20 may be coupled to the forward rail support arm 44. In particular, the transition seal system 20 may be formed from one or more transition seal support cavities 52 configured to support a transition seal 54 extending between the turbine vane ID support body 14 and the transition 22. In one embodiment, the transition seal 54 may be bent such that a portion 56 of the transition seal that contacts the transition 22 is generally orthogonal to a portion 58 of the transition seal 54 housed in the transition seal support cavity 52. The transition seal 54 may be formed from any appropriate material.

The turbine vane ID support system 10 may include a turbine vane ID forward rail seal system 24 extending from the turbine vane ID support body 14 to seal the turbine vane ID support body 14 to a turbine vane ID forward rail 26 of a turbine vane 12. In one embodiment, the turbine vane ID forward rail seal system 24 may be attached to the forward rail support arm 44. As shown in FIG. 3, the turbine vane ID forward rail seal system 24 may be formed from a forward rail seal support cavity 60 configured to support a forward rail seal 62 extending between the turbine vane ID support body 14 and a turbine vane 12. The forward rail seal 62 may extend from the forward rail seal support cavity 60 to a cavity 63 in the forward turbine vane rail 26. The forward rail seal 62 may be formed from any appropriate material.

The turbine vane ID support system 10 may include an aft rail support arm 64 extending from the turbine vane ID support body 14 aft of the forward rail support arm 44. The aft rail support arm 64 may extend from the base 16 and terminate within close proximity of an aft turbine vane rail 66 but offset a distance sufficient to avoid contact because of thermal expansion and vibration. A turbine vane ID aft rail seal system 68 may extend from the aft rail support arm 64 to seal the aft turbine vane rail 66 to the turbine vane ID support body 14. In one embodiment, the turbine vane ID aft rail seal system 68 may be formed from one or more aft rail seal cavities 70 in the aft rail support arm 64. An aft rail seal 72 may extend from the aft rail seal cavity 70 and terminate in a cavity 74 in the aft turbine vane rail 66. The aft rail seal 72 may be formed from any appropriate material.

During use, aero loads are applied to a pressure side 76 of the turbine vane 12. With the turbine vane 12 secured at the forward turbine vane rail 26, both the ID rails 46, 66 and OD rails remain axially seated unlike conventional systems in which aero loads often unseat the pressure side rail corner, which results in leakage and sawtoothing at the shroud leading edge.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine vane ID support system, comprising:

a turbine vane ID support body with a base configured to be attached to a shaft cover;

a transition seal system extending from the turbine vane ID support body to seal the turbine vane ID support body to a transition; and a turbine vane ID forward rail seal system extending from the turbine vane ID support body to seal the turbine vane ID support body to a turbine vane ID forward rail of a turbine vane.

2. The turbine vane ID support system of claim 1, wherein the turbine vane ID support body further comprises a forward rail support arm extending from the turbine vane ID support body, wherein the transition seal system and the turbine vane ID forward rail seal system are coupled to the forward rail support arm.

3. The turbine vane ID support system of claim 2, wherein the forward rail support arm includes at least one forward rail receiving slot configured to slideably receive the turbine vane ID forward rail.

4. The turbine vane ID support system of claim 1, further comprising an aft rail support arm extending from the turbine vane ID support body aft of the forward rail support arm.

5. The turbine vane ID support system of claim 4, further comprising a turbine vane ID aft rail seal system extending from the aft rail support arm to seal an aft turbine vane rail to the turbine vane ID support body.

6. The turbine vane ID support system of claim 5, wherein the turbine vane ID aft rail seal system comprises at least one aft rail seal cavity in the aft rail support arm, wherein the at least one aft rail seal cavity houses at least one aft rail seal.

7. The turbine vane ID support system of claim 1, wherein the transition seal system comprises a transition seal support cavity configured to support a transition seal extending between the turbine vane ID support body and the transition.

8. The turbine vane ID support system of claim 7, further comprising the transition seal extending from the turbine vane ID support body, wherein the transition seal is bent such that a portion of the transition seal that contacts the transition is generally orthogonal to a portion of the transition seal housed in the transition seal support cavity.

9. The turbine vane ID support system of claim 1, wherein the turbine vane ID forward rail seal system comprises a forward rail seal support cavity configured to support a forward rail seal extending between the turbine vane ID support body and the turbine vane.

10. The turbine airfoil of claim 1, wherein the turbine vane ID support body is formed from a plurality of struts forming at least one cooling fluid flow channel through the turbine vane ID support body.

11. A turbine vane ID support system, comprising:

a turbine vane ID support body with a base configured to be attached to a shaft cover;

a forward rail support arm extending from the turbine vane ID support body;

at least one forward rail receiving slot positioned in the forward rail support arm that is configured to slideably receive a forward turbine vane rail;

a transition seal system positioned on the forward rail support arm to seal the turbine vane ID support body to a transition; and a turbine vane ID forward rail seal system positioned on the forward rail support arm to seal the turbine vane ID support body to a turbine vane ID forward rail of a turbine vane.

12. The turbine vane ID support system of claim 11, further comprising an aft rail support arm extending from the turbine vane ID support body aft of the forward rail support arm.

13. The turbine vane ID support system of claim 12, further comprising a turbine vane ID aft rail seal system extending from the aft rail support arm to seal an aft turbine vane rail to the turbine vane ID support body.

14. The turbine vane ID support system of claim 13, wherein the turbine vane ID aft rail seal system comprises at least one aft rail seal cavity in the aft rail support arm, wherein the at least one aft rail seal cavity houses at least one aft rail seal.

15. The turbine vane ID support system of claim 11, wherein the transition seal system comprises a transition seal support cavity configured to support a transition seal extending between the turbine vane ID support body and a transition.

16. The turbine vane ID support system of claim 15, further comprising a transition seal extending from the turbine vane ID support body, wherein the transition seal is bent such that a portion of the transition seal that contacts the transition is generally orthogonal to a portion of the transition seal housed in the transition seal support cavity.

17. The turbine vane ID support system of claim 11, wherein the turbine vane ID forward rail seal system comprises a forward rail seal support cavity configured to support a forward rail seal extending between the turbine vane ID support body and the turbine vane.

18. The turbine airfoil of claim 11, wherein the turbine vane ID support body is formed from a plurality of struts forming at least one cooling fluid flow channel through the turbine vane ID support body.

19. A turbine vane ID support system, comprising:

a turbine vane ID support body with a base configured to be attached to a shaft cover, wherein the turbine vane ID support body is formed from a plurality of struts forming at least one cooling fluid flow channel through the turbine vane ID support body;

a forward rail support arm extending from the turbine vane ID support body;

at least one forward rail receiving slot positioned in the forward rail support arm that is configured to slideably receive a forward turbine vane rail;

a transition seal system positioned on the forward rail support arm to seal the turbine vane ID support body to a transition, wherein the transition seal system comprises a transition seal support cavity configured to support a transition seal extending between the turbine vane ID support body and a transition; and a turbine vane ID forward rail seal system positioned on the forward rail support arm to seal the turbine vane ID support body to a turbine vane ID forward rail of a turbine vane, wherein the turbine vane ID forward rail seal system comprises a forward rail seal support cavity configured to support a forward rail seal extending between the turbine vane ID support body and the turbine vane.

20. The turbine vane ID support system of claim 19, further comprising an aft rail support arm extending from the turbine vane ID support body aft of the forward rail support arm and a turbine vane ID aft rail seal system extending from the aft rail support arm to seal an aft turbine vane rail to the turbine vane ID support body; wherein the turbine vane ID aft rail seal system comprises at least one aft rail seal cavity in the aft rail support arm, wherein the at least one aft rail seal cavity houses at least one aft rail seal.

* * * * *